US010247529B2

(12) United States Patent
Granier et al.

(10) Patent No.: US 10,247,529 B2
(45) Date of Patent: Apr. 2, 2019

(54) REACTIVE SHOT SHELL FOR BREACHING BARRIERS

(71) Applicant: Energetic Materials & Products, Inc., Round Rock, TX (US)

(72) Inventors: John Joseph Granier, Round Rock, TX (US); Dennis Eugene Wilson, Cedar Park, TX (US); Joel Brad Bailey, Austin, TX (US)

(73) Assignee: Energetic Materials & Products, Inc., Round Rock, TX (US)

( * ) Notice: Subject to any disclaimer, the term of this patent is extended or adjusted under 35 U.S.C. 154(b) by 0 days.

(21) Appl. No.: 16/018,346

(22) Filed: Jun. 26, 2018

(65) Prior Publication Data

US 2018/0372463 A1 Dec. 27, 2018

Related U.S. Application Data

(60) Provisional application No. 62/604,175, filed on Jun. 26, 2017.

(51) Int. Cl.

| | |
|---|---|
| ***F42B 7/08*** | (2006.01) |
| ***F42B 12/46*** | (2006.01) |
| ***F42B 12/20*** | (2006.01) |
| ***C06B 33/00*** | (2006.01) |
| ***C06B 27/00*** | (2006.01) |

(52) U.S. Cl.

CPC ..... *F42B 7/08* (2013.01); *C06B 27/00* (2013.01); *C06B 33/00* (2013.01); *F42B 12/204* (2013.01); *F42B 12/46* (2013.01)

(58) Field of Classification Search

CPC ..... F42B 7/08; F42B 7/04; F42B 5/145

See application file for complete search history.

(56) References Cited

U.S. PATENT DOCUMENTS

| | | | | |
|---|---|---|---|---|
| 3,724,378 | A * | 4/1973 | Knight | F42B 7/04 102/448 |
| 4,295,426 | A * | 10/1981 | Genco | F42B 7/08 102/451 |
| 6,564,720 | B1 * | 5/2003 | Meyer | F42B 7/10 102/439 |
| 7,977,420 | B2 * | 7/2011 | Nielson | C06B 27/00 524/439 |
| 9,494,397 | B2 * | 11/2016 | Carlson | F42B 12/40 |
| 2007/0272112 | A1 * | 11/2007 | Nielson | C06B 27/00 102/473 |
| 2011/0067593 | A1 * | 3/2011 | Klein | F42B 5/02 102/439 |
| 2014/0190364 | A1 * | 7/2014 | Peterson | F42B 7/08 102/439 |

* cited by examiner

*Primary Examiner* — Benjamin P Lee

(74) *Attorney, Agent, or Firm* — Russell Ng PLLC

(57) ABSTRACT

A shot shell is disclosed. The shot shell includes a casing, a projectile, a cushion wad having a sabot, a propellant, and a primer for igniting the propellant. The projectile, the cushion and the propellant are contained within the casing. The projectile includes a reactive material pellet that is partially covered by a taper-shaped inert capsule.

15 Claims, 3 Drawing Sheets

REACTIVE SHOT SHELL FOR BREACHING BARRIERS

PRIORITY CLAIM

The present application claims priority under 35 U.S.C. § 119(e)(1) to provisional application No. 62/604,175, filed on Jun. 26, 2017, the contents of which are incorporated herein by reference.

BACKGROUND OF THE INVENTION

1. Technical Field

The present invention relates to munitions in general, and in particular to munitions for allowing law enforcement and military personnel to perform forced-entry via explosive breaching.

2. Description of Related Art

In certain tactical situations, law enforcement and military personnel are called upon to gain entry into a barricaded structure such as a barricaded door. It is a standard practice for the barricaded door to be approached by a squad of four to five personnel stacked in a line. The first (front) person of the squad is charged with the task of breaching the door. Once the door has been breached, the remaining members of the squad can rush through the door.

A battering ram is commonly used to breach a door. Most battering rams are basically heavy pipes, which weigh approximately forty pounds, with handles. A battering ram can be swung into a door in the vicinity of a latch to break open the door. It typically takes both hands to breach a door in this manner. As a result, the operator who is charged with breaching the door is completely exposed when the door bursts open.

Shot shells have also been utilized to breach doors. Basically, a shot shell is fired at a door in the vicinity of a lock, handle or hinges to break open the door. Shot a shells for use in door-breaching applications should penetrate the door while without causing harm to people or structures located beyond three feet of the opposite side of the door. In addition, shot shells should not produce lethal fragments upon impact with the door. However, conventional shotgun shells tend to produce ricochet and back spray. Thus, conventional shotgun shells are not good choices for breaching doors.

Consequently, it would be desirable to provide an improved apparatus for to breaching doors.

SUMMARY OF THE INVENTION

In accordance with a preferred embodiment of the present invention, a shot shell includes a casing, a projectile, a cushion wad having a sabot, a propellant, and a primer for igniting the propellant. The projectile, the cushion and the propellant are contained within the casing, The projectile includes a reactive material pellet that is partially covered by a taper-shaped inert capsule.

All features and advantages of the present invention will become apparent to in the following detailed written description.

BRIEF DESCRIPTION OF THE DRAWINGS

The invention itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

A tactical door-breaching operation can be performed using a shotgun with its muzzle in contact with (or as close as possible to) a door. One or more shots are then fired into the door jamb to break open the door. Muzzle attachments are available on some specialized breaching shotguns to facilitate the door-breathing operation. A muzzle attachment allows the barrel of a shotgun to be securely held in place while providing a a slight standoff to allow powder gases to escape.

Figure 1:
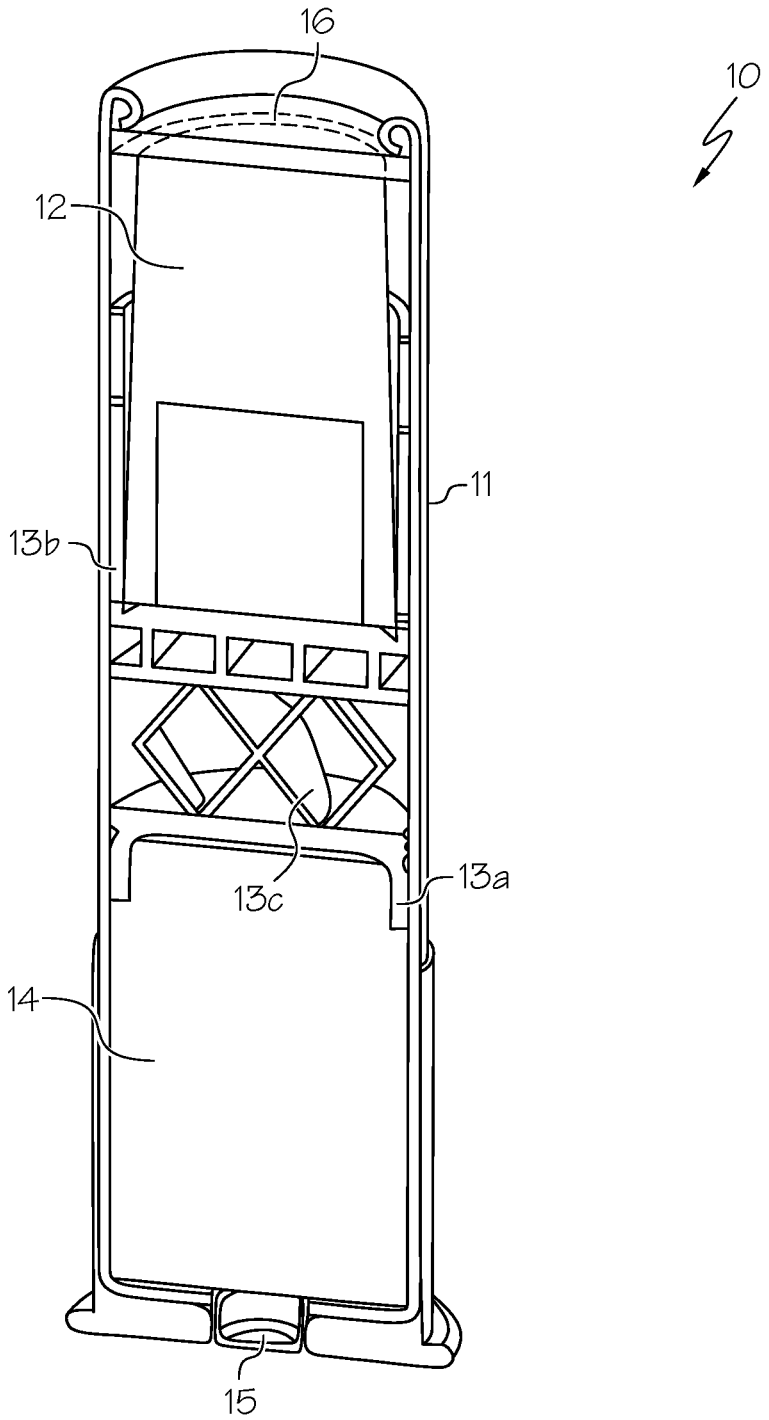
FIG. 1 is an isometric cutout view of a shot shell, in accordance with one embodiment.

Referring now to the drawings and in particular to FIG. 1, there is illustrated an isometric cutout view of a shot shell to be used for breaching barriers, such as doors, in accordance with one embodiment. As shown, a shot shell 10 includes a casing 11 carrying a projectile 12, a cushion (or obturating) wad 13, a propellant 14, and a primer 15. In addition, a clear cap 16 is placed on one end of projectile 12 in order to enable a better roll crimp on casing 11, which is beneficial for sealing the top end of shot shell 10. Shot shell 10 can be of a medium caliber (such as 35 mm, 30 mm, 25 mm and 20 mm) projectile round capable of being fired from a shotgun. If shot shell 10 is a 12-gauge shot shell, the total launch mass of projectile 12 can range from 31 g to 35 g.

Cushion wad 13 has a first polymer cup 13*a* for generating a pressure energized seal for obturation. Cushion wad 13 also has a second polymer cup 13*b* that cradles projectile 12 in order to center and protect projectile 12 from barrel friction when projectile 12 is traveling through the barrel of a shotgun. In addition, cushion wad 13 includes a sabot 13*c* for reducing the shock load during initial acceleration after shot shell 10 has been fired. After leaving the muzzle of the shotgun, cushion wad 13 may stay in place to create tail-drag stabilized flight or may be stripped away by air drag; but either way, cushion wad 13 is not critical to target damage effectiveness.

Figure 3:
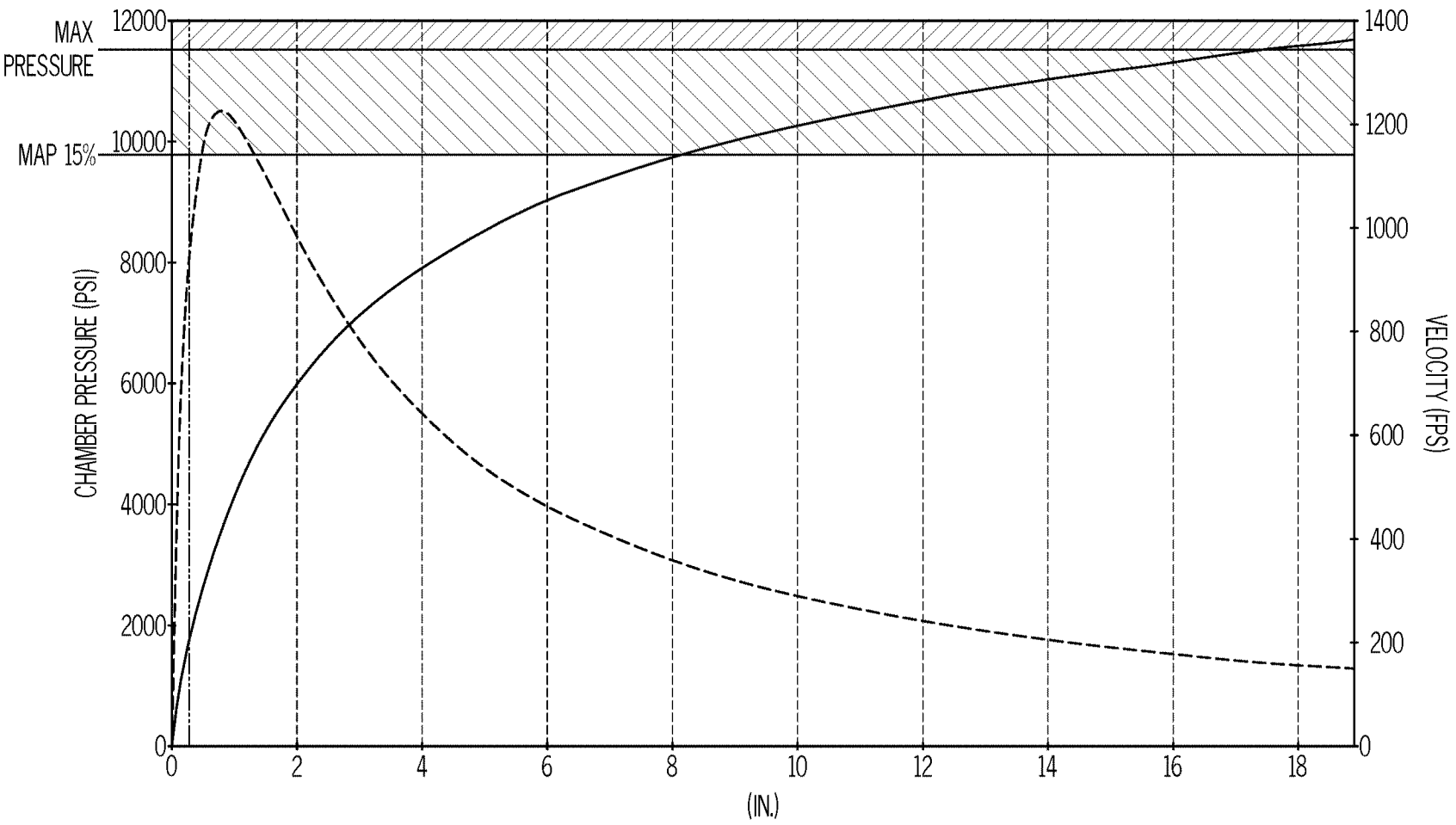
FIG. 3 is a graph showing chamber pressure of a 35 g package using 2.13 g of HS-6 propellant.

Propellant 14 is a smokeless propellant designed to achieve maximum velocity while limiting the chamber pressure of shot shell 10 to 12,000 psi. All loads were based on tamped stack of propellant 14, cushion wad 13, and projectile 12 with no ullage around propellant 14. An example load for a 35 g package using 2.13 g of HS-6 propellant is shown in FIG. 3. This example load requires a 3.0 inch hull (starting at 3.25 inch) after roll crimp. This example load shows a predicted muzzle velocity of 1,362 ft/s using a 20-inch barrel or 1,200 ft/s from a 10-inch barrel.

Figure 2:
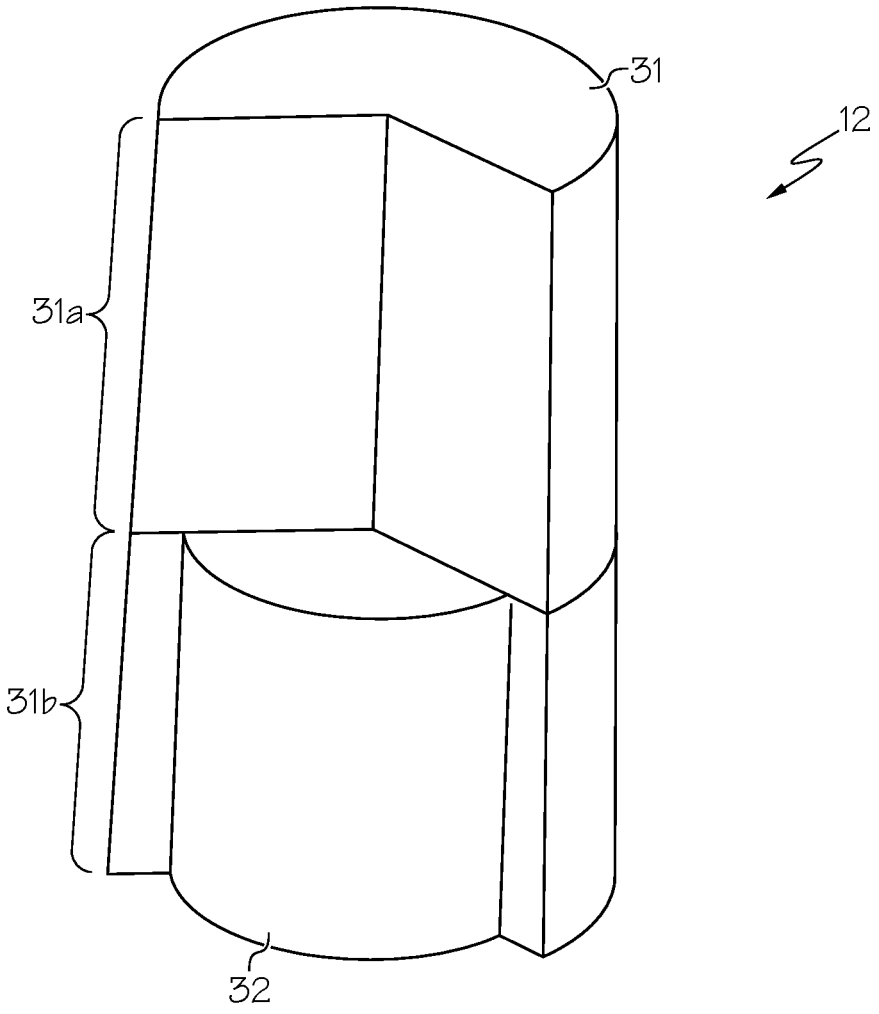
FIG. 2 is an isometric cutout view of a projectile within the shot shell from FIG. 1, in accordance with one embodiment.

With reference now to FIG. 2, there is illustrated an isomeric cutout view of projectile 12, in accordance with one embodiment. As shown, projectile 12 includes an inert capsule 31 and a reactive material (RM) pellet 32. Inert capsule 31 is in a generally tapered shape with, for example, a 0.595 diameter at one end and a 0.660 diameter at the opposite end. Inert capsule 31, which includes a nose 31*a* and an annulus 31*b*, is made of tungsten powder combined with an epoxy binder. The height of nose 31*a* is, for example, 0.610 in, and the height of annulus 31*b* is, for example, 0.500 in. Inert capsule 31 serves to generate a forward center of gravity for a stable flight of projectile 12 and to enable good penetration of projectile 12 into an intended target.

RM pellet 32 is embedded within one end of inert capsule 31. Stability of projectile 12 in flight is optimized by controlling mass distribution within inert capsule 31. Since it is often more desirable to have a forward center of gravity, thus a higher density metal powder is employed in the forward portion of inert capsule 31 while a lower density metal powder is employed in the rear portion of inert capsule 31. Additionally, the inertial confinement of RM pellet 32 can be altered by modulating the density of inert capsule 31, which can affect the reactivity of RM pellet 32.

RM pellet 32 is substantially cylindrical in shape. The height and diameter of RM pellet 32 are, for example, 0.350 in and 0.500 in, respectively. RM pellet 32 is concentric with inert capsule 31.

The RM within RM pellet 32 is made up of energetic materials that include two or more solid-state reactants that together form a thermochemical mixture. For example, RMs may include metal-metal and/or metal-metal oxide mixtures with and without binders included. Reactive materials have higher predicted energy per unit volume than conventional energetics and can provide alternate kill mechanisms besides those from conventional energetics.

For example, RM pellet 32 can be made of various reactive materials or from a mixture of reactive materials, including binders, fuels and oxidizers. Binding agent is required due to the high forces during launch. The binder in RM pellet 32 may include a small percentage of PTFE, wax, lacquer, epoxy, or other polymers. The binder is used in the reactive material to provide improved processability, safety, or performance. If the reactive material is to be pressed, the reactive material may include at least one fuel and at least one oxidizer, or at least two fuels. The reactive material may be an intermetallic composition or a thermitic composition, or other pyrotechnic composition. The fuel may include aluminum, iron, zirconium, magnesium, zinc, titanium, lithium, boron, and/or alloys. The oxidizer may include potassium perchlorate, potassium chlorate, potassium nitrate, ammonium perchlorate, ammonium chlorate, ammonium nitrate, lithium perchlorate, lithium chlorate, lithium nitrate, molybdenum oxide, copper oxide, tungsten oxide, iron oxide, bismuth oxide, polytetrafluoroethylene (PTFE), perfluoropolyether (PFPE) and a combination thereof.

In order to reduce collateral damages behind a target, projectile 12 is made from metal powders and binders. Additional adjustments can be made on projectile 12 to potentially improve the performance of projectile 12. For example, the mass and type of RM pellet 32 can be tuned up or down to manage target damage and operator safety. The dimensions and shape of RM pellet 32 can be tuned to improve fabrication and alter the expansion effects of annulus 31*b*. The mass of nose 31*a* and the net mass of projectile 12 can be altered to manage cartridge, recoil, and barrel requirements. The reactive material within RM pellet 32 can be pressed or cast to improve manufacturing costs.

After shot shell 10 has been fired from a shot gun at a target, inert capsule 31 penetrates the target and protects RM pellet 32 temporarily. Once projectile 12 enters the target and continues to impact secondary surfaces, RM pellet 32 is initiated inside the target. The heat and gas energy released from RM pellet 32 generates expansion, tearing, melting, and burning inside the target for maximum damage. Secondly, inert capsule 31 is comprised of inert metal powder around RM pellet 32 that is accelerated radially inside the target like a fragmenting warhead. The kinetic impacts of high-mass annulus 31*b* (cloud or fragments) generates more damage than expanding gas alone.

Inert capsule 31 can be cast or pressed into a mold, and RM pellet 32 can be cast or pressed into a void in inert capsule 31. Alternatively, RM pellet 32 can be cast or pressed separately, inert capsule 31 can be formed around RM pellet 32 by casting or pressing. Nose 31*a* of inert capsule 31 can be made of a higher bulk density material, pressed or cast; and annulus 31*b* of inert capsule 31 can be made of a higher strength material, pressed or cast. Alternatively, nose 31*a* and annulus 31*b* can be made of an identical material with monolithic construction, pressed or cast. RM pellet 32 is fabricated by first mechanically mixing the powder precursors and then mechanically pressing the powder precursors around 25 ksi in a cylindrical die.

The diameter of RM pellet 32 may range from 0.250 to 0.500 inch. Variation in RM pellet 32's mass is altered by varying the length and/or the diameter. RM pellet 32 is held concentric relative to nose 31*a*. Projectile 12 may be formed into a desired configuration by pressing, casting, extruding, or injection molding.

As has been described, the present invention provides an improved shot shell for breaching barriers made of metal, wood or masonry.

While the invention has been particularly shown and described with reference to a preferred embodiment, it will be understood by those skilled in the art that various changes in form and detail may be made therein without departing from the spirit and scope of the invention.

What is claimed is:

1. A shot shell comprising:

a casing;

a projectile, located within said casing, includes a reactive material (RM) pellet; and an inert capsule partially covers said RM pellet, wherein said inert capsule includes a nose having metal powder and an annulus having metal powder, wherein said metal powder in said nose has a higher density than said metal powder in said annulus;

a wad, located within said casing, includes a sabot; and a propellant and a primer for igniting said propellant.

2. The shot shell of claim 1, wherein said inert capsule is in a tapered shape.

3. The shot shell of claim 1, wherein said nose and said annulus are made of the same material.

4. The shot shell of claim 1, wherein said nose and said annulus are made of different materials.

5. The shot shell of claim 1, wherein said RM pellet is concentric to said inert capsule.

6. The shot shell of claim 1, wherein said RM pellet is a homogeneous structure within said inert capsule.

7. The shot shell of claim 1, wherein said RM pellet is made of a plurality of reactive materials.

8. The shot shell of claim 7, wherein said reactive materials includes at least one binder, at least one fuel and at least one oxidizer.

9. The shot shell of claim 8, wherein said fuel includes at least one of aluminum, iron, zirconium, magnesium, zinc, titanium, lithium, boron, and alloys.

10. The shot shell of claim 8, wherein said oxidizer includes at least one of potassium perchlorate, potassium chlorate, potassium nitrate, ammonium perchlorate, ammonium chlorate, ammonium nitrate, lithium perchlorate, lithium chlorate, lithium nitrate, molybdenum oxide, copper oxide, tungsten oxide, iron oxide, bismuth oxide, polytetrafluoroethylene (PTFE), perfluoropolyether (PFPE) and combinations thereof.

11. The shot shell of claim 1, wherein said inert capsule has a forward-biased center of gravity in order to provide flight stability.

12. The shot shell of claim 1, wherein said inert capsule is cast into a mold, and said RM pellet is cast into a void in said inert capsule.

13. The shot shell of claim 1, wherein said inert capsule is pressed into a mold, and said RM pellet is pressed into a void in said inert capsule.

14. The shot shell of claim 1, wherein said inert capsule is formed around said RM pellet by casting.

15. The shot shell of claim 1, wherein said inert capsule is formed around said RM pellet by pressing.

* * * * *